US010136727B2

(12) United States Patent
Freelander

(10) Patent No.: US 10,136,727 B2
(45) Date of Patent: Nov. 27, 2018

(54) BOOT RACK WITH ANGLED SUPPORT

(71) Applicant: Richards Homewares, Inc., Portland, OR (US)

(72) Inventor: Robert Freelander, Portland, OR (US)

(73) Assignee: Richards Homewares, Inc., Portland, OR (US)

( * ) Notice: Subject to any disclaimer, the term of this patent is extended or adjusted under 35 U.S.C. 154(b) by 0 days.

(21) Appl. No.: 15/015,781

(22) Filed: Feb. 4, 2016

(65) Prior Publication Data

US 2017/0224107 A1 Aug. 10, 2017

(51) Int. Cl.
*A47B 61/04* (2006.01)
*A47F 7/08* (2006.01)
*A47B 96/06* (2006.01)

(52) U.S. Cl.
CPC ..... *A47B 61/04* (2013.01); *A47B 96/06* (2013.01); *A47F 7/08* (2013.01)

(58) Field of Classification Search
CPC ..... A47F 7/08; A47B 61/04; A47B 96/06
USPC ..... 248/229.1, 229.15, 230.4, 231.61
See application file for complete search history.

(56) References Cited

U.S. PATENT DOCUMENTS 561,865 A * 6/1896 Casler ..... A47F 7/08 211/34
595,196 A * 12/1897 Newman et al. ..... A47F 7/08 211/34
1,589,198 A * 6/1926 McComb ..... A47F 5/12 211/150
1,703,190 A * 2/1929 Glidden ..... A43D 117/00 211/34
2,311,932 A * 2/1943 Deckard ..... E21B 19/14 182/38
2,605,069 A * 7/1952 Gillaspy ..... A61J 9/0638 248/103
2,695,106 A * 11/1954 Cohen ..... A47B 61/04 211/38
2,740,970 A * 4/1956 Fagundus ..... D06F 41/00 24/332
2,815,862 A * 12/1957 Einhorn ..... A47B 61/04 211/189
2,836,306 A * 5/1958 Einhorn ..... A47B 61/04 211/189
2,989,188 A * 6/1961 Auer ..... A43D 117/00 211/34
3,664,514 A * 5/1972 Drake ..... A47B 57/045 16/332
4,458,870 A * 7/1984 Duncan ..... A47C 7/70 248/279.1
4,699,267 A * 10/1987 Burke ..... A45C 3/12 190/13 F (Continued)

*Primary Examiner* — Daniel J Troy
*Assistant Examiner* — Kimberley S Wright
(74) *Attorney, Agent, or Firm* — Chernoff Vilhauer LLP

(57) ABSTRACT

A boot rack with angled support, including a frame having a central bar extending between a pair of support feet, such that the pair of support feet engages a surface, and at least one elongate boot support element having a first end and a second end. The first end of the support element includes a fixed component and a rotating component, such that the fixed component is attached to the central bar, and the rotating component is connected to the fixed component via a hinge connection. The hinge connection can define an axis which allows the rotating component to rotate about the axis.

9 Claims, 4 Drawing Sheets

(56) References Cited

U.S. PATENT DOCUMENTS

| | | | | |
|---|---|---|---|---|
| 4,917,343 | A * | 4/1990 | Wainscott | A47B 23/06 248/284.1 |
| 5,014,949 | A * | 5/1991 | Niven | A47F 5/0823 211/57.1 |
| 5,154,390 | A * | 10/1992 | Bain | A47B 97/04 248/284.1 |
| 6,315,256 | B1 * | 11/2001 | Tolar | F41A 23/00 248/230.4 |
| 7,055,784 | B2 * | 6/2006 | Stigler | B60R 16/0215 24/16 PB |
| 7,406,795 | B1 * | 8/2008 | Follmar | A01K 97/10 248/534 |
| 7,775,410 | B2 | 8/2010 | Zamzow | |
| 8,011,629 | B2 * | 9/2011 | Herskovic | A61G 7/0503 248/229.13 |
| D732,815 | S | 6/2015 | Sokolowski | |
| 9,709,217 | B2 * | 7/2017 | Trinh | F16M 13/022 |
| 2005/0230332 | A1 * | 10/2005 | Taylor | A47F 7/08 211/34 |
| 2008/0142560 | A1 * | 6/2008 | Lim | B60R 7/08 224/543 |
| 2009/0008345 | A1 * | 1/2009 | Sabounjian | A47F 7/08 211/35 |
| 2010/0066222 | A1 * | 3/2010 | Ito | A47B 61/04 312/326 |

* cited by examiner

BOOT RACK WITH ANGLED SUPPORT

BACKGROUND OF THE INVENTION

Boots often require a different manner of storage than regular shoes. Regular shoes have short necks, such that when left unused, do not require any additional support for their necks. On the other hand, boots with longer necks, when stored, generally do not have any built-in support to prevent the longer neck from bending or buckling. Such bending is particularly a problem for leather boots, which are more susceptible to noticeable wear due to bending or buckling of the leather, thereby changing the appearance and shape of the boot.

During warmer months, when boots are not being used, boot owners sometimes stuff the inside of the boot with material such as newspaper, to provide structure to avoid bending of the boot. Other users may simply store their boots on their sides, so that they lay flat. However, these storing methods may still result in undesirable folding and resulting creases in the boots.

SUMMARY OF THE INVENTION

In one embodiment, the present invention includes a boot rack capable of storing multiple boots in a vertical stored position on elongate support elements, and allowing a user to access the stored boots by tilting individual support elements. The present invention allows for easy access of such stored boots.

In one embodiment, the present invention includes a frame having a central bar extending between a pair of support feet, such that the pair of support feet engages a surface, and at least one elongate boot support element having a first end and a second end. The first end of the support element includes a fixed component and a rotating component, such that the fixed component is attachable to the central bar, and the rotating component is connected to the fixed component via a hinge connection. The hinge connection can define an axis which allows the rotating component to rotate about the axis.

In another embodiment, the invention includes a floor-contacting support base and at least one elongate boot holder, which is reversibly attachable to the support base, and a hinge that connects the boot holder to the base, such that he hinge allows the boot holder to rotate forward and backward around an axis defined by the hinge.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
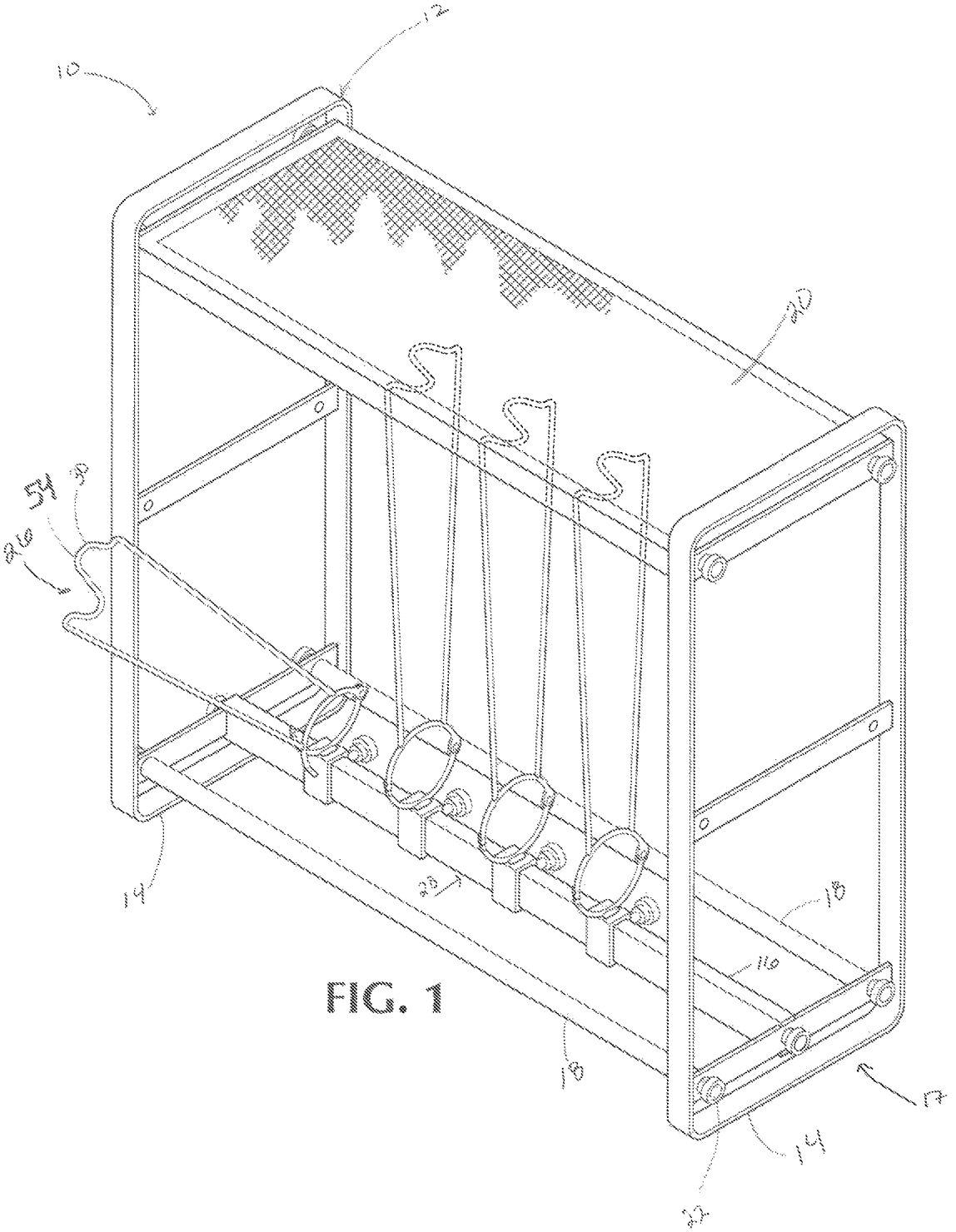
FIG. 1 is an isometric view from above and ahead of the left side of the boot rack.

Referring to the drawings which form part of the disclosure herein, FIG. 1 shows one embodiment of the boot rack 10. The boot rack 10 shown has a frame, indicated generally at 12 and a pair of support feet 14, which engage the floor or any surface. In this embodiment of the invention, the support feet 14 are flat, elongate horizontal beams, but other structures that support the frame 12 may be employed to serve the same purpose. A central bar 16 is attachable to and extends between the pair of support feet 14. The central bar 16 engaged with the support feet 14 together may be referred to a floor-contacting support base 17. In the embodiment shown in FIG. 1, the boot rack 10 also includes two additional bars 18 that extend between the support feet 14. Such additional bars 18 may be employed to improve stability of the frame 12. The frame 12 may also include a shelf 20, positioned at a location above the central bar 16. Components of the frame 12 may be joined by the use of screws 22. As shown in FIG. 1, the screws 22 may be used to attach the shelf 20, the central bar 16 and the additional bars 18 to the frame. In other embodiments of the invention, components of the frame 12 (such as the bars 16, 18 and the shelf 20) may be attached together by using welding or adhesives.

The embodiment shown in FIG. 1 also includes four elongate boot supports 26, generally attachable to the central bar 16, as will be described in more detail with reference to FIGS. 2-5. Other embodiments, however, may have any number of boot supports 26 depending on the desired storage capacity. Each boot support 26 includes a first end, indicated generally at 28, and a second end 30.

Figure 2:
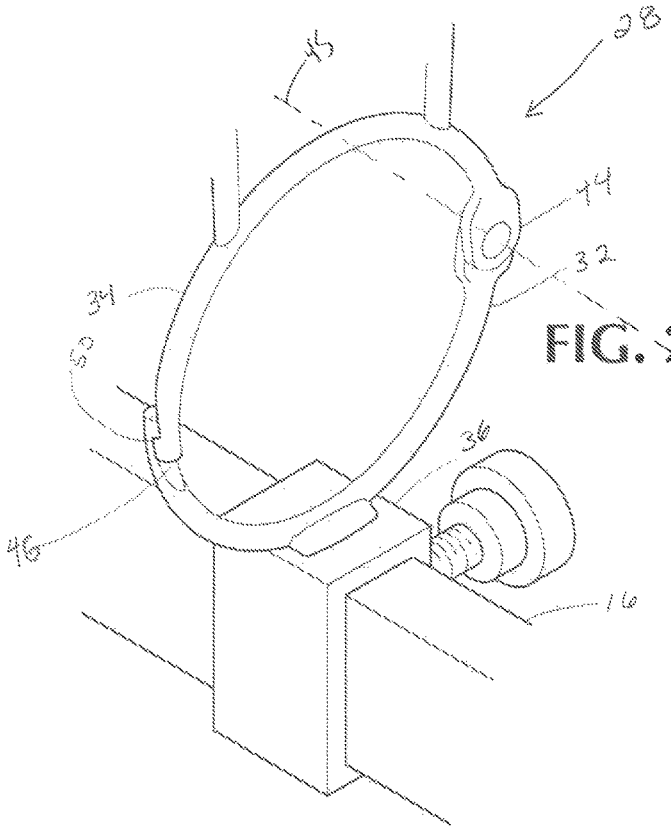
FIG. 2 is an enlarged isometric view of the locking mechanism in a locked position.
Figure 3:
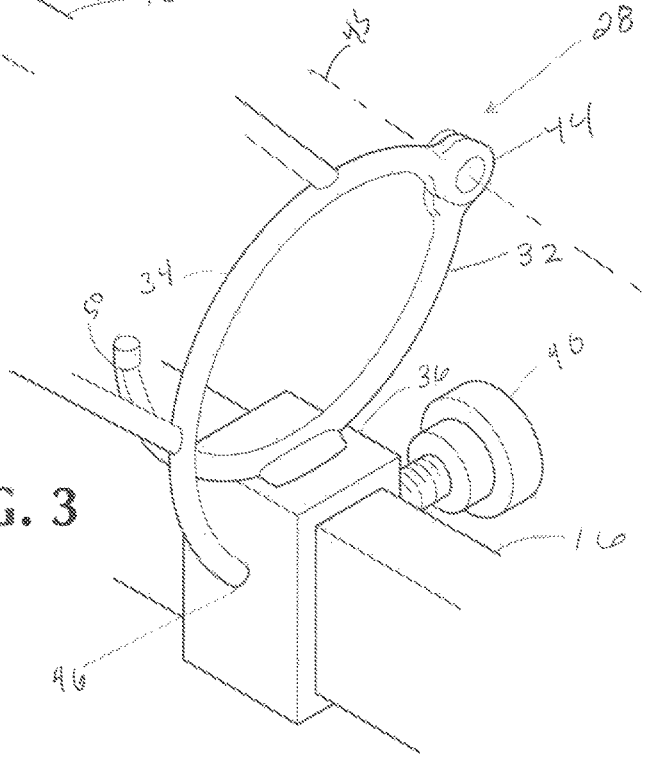
FIG. 3 is an enlarged isometric view of the locking mechanism in an unlocked and stopped position.

FIGS. 2 and 3 show the elements and mechanism which allows the elongate boot supports 26 to be tilted to allow a user to easily access a stored boot. As shown in detail in FIGS. 2 and 3, the first end 28 includes a fixed component 32, and a rotating component 34. The fixed component 32, in this embodiment, is attached to a collar 36, the collar 36 having an aperture that is sized and shaped to accept and slide along the central bar 16. In this embodiment of the invention, the collar 36 has a rectangular aperture because the central bar 16 has a rectangular cross-sectional shape. The engagement between the collar 36 and the central bar 16 can allow a user to select the position of the boot support 26 on the central bar 16 by sliding the collar along the central bar 16. The central bar 16 may also include one or more holes 24, sized to accept positioning screws 40, as will be described in more detail. The central bar holes 24, may be positioned along one side of the central bar 16, as best viewed in FIGS. 4 and 5, at locations where a collar 36, and thereby an elongate boot support 26, is to be attached. The collar 36 also includes a hole 38 sized to accept a threaded screw 40, such that the screw 40 may be inserted into the collar hole 38 and into a central bar hole 24, as best viewed in FIGS. 4 and 5.

In this embodiment of the invention, to fasten the collar 36 and the associated boot support 26, to a position on the central bar 16, a user aligns a central bar hole 24 with the hole in the collar 36, and twists the screw 40 in the hole 38, thereby engaging the end of the screw 40 with a side of the central bar 16. Conversely, the collar 36 may be unfastened from the central bar 16 by twisting the screw 40 in an opposite direction. In this embodiment of the invention, the collar 36, has a threaded element 42 with a thickness that is capable of supporting the screw 40 when it is not engaged with the central bar 16.

Figure 5:
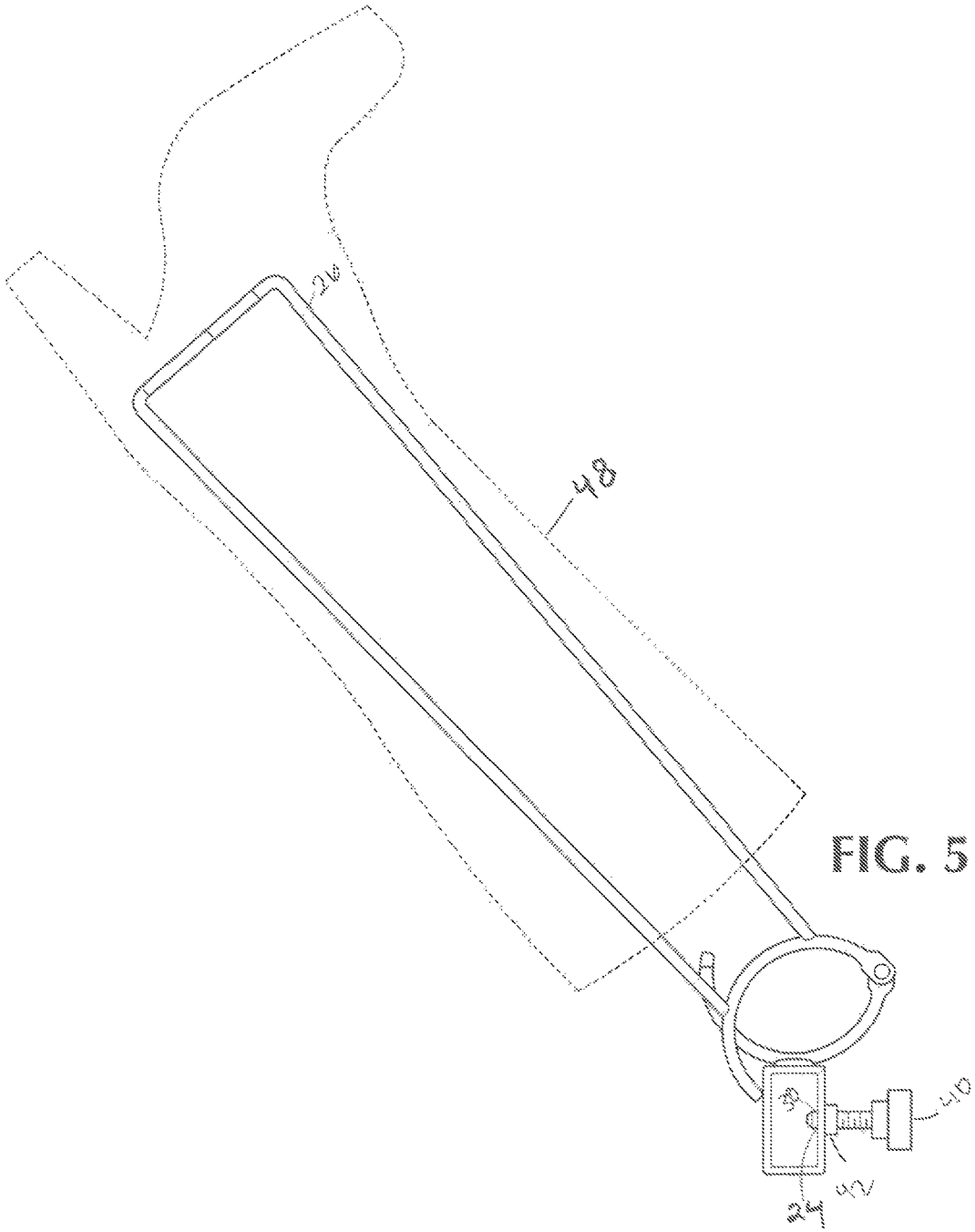
FIG. 5 is a side elevation view of a boot holder with a boot, in an unlocked and stopped position.

A hinge joint 44 attaches the fixed component 32 to the rotating component 34. The hinge joint 44, allows the rotating component 34 to rotate about the axis of the hinge 45, such that the axis 45 is parallel to the direction of the central bar 16, until the end of the rotating component 46 contacts the collar 36, as shown in FIG. 3, to allow a user to easily access a stored boot. Such a configuration is also shown in FIG. 5. By structuring the rotating component 34 in a manner so that the end of the rotating component 46 contacts the collar 36 at a given point of rotation, the boot support 26 is prevented from over rotation and thereby allows a user to easily access such a boot 48.

Figure 4:
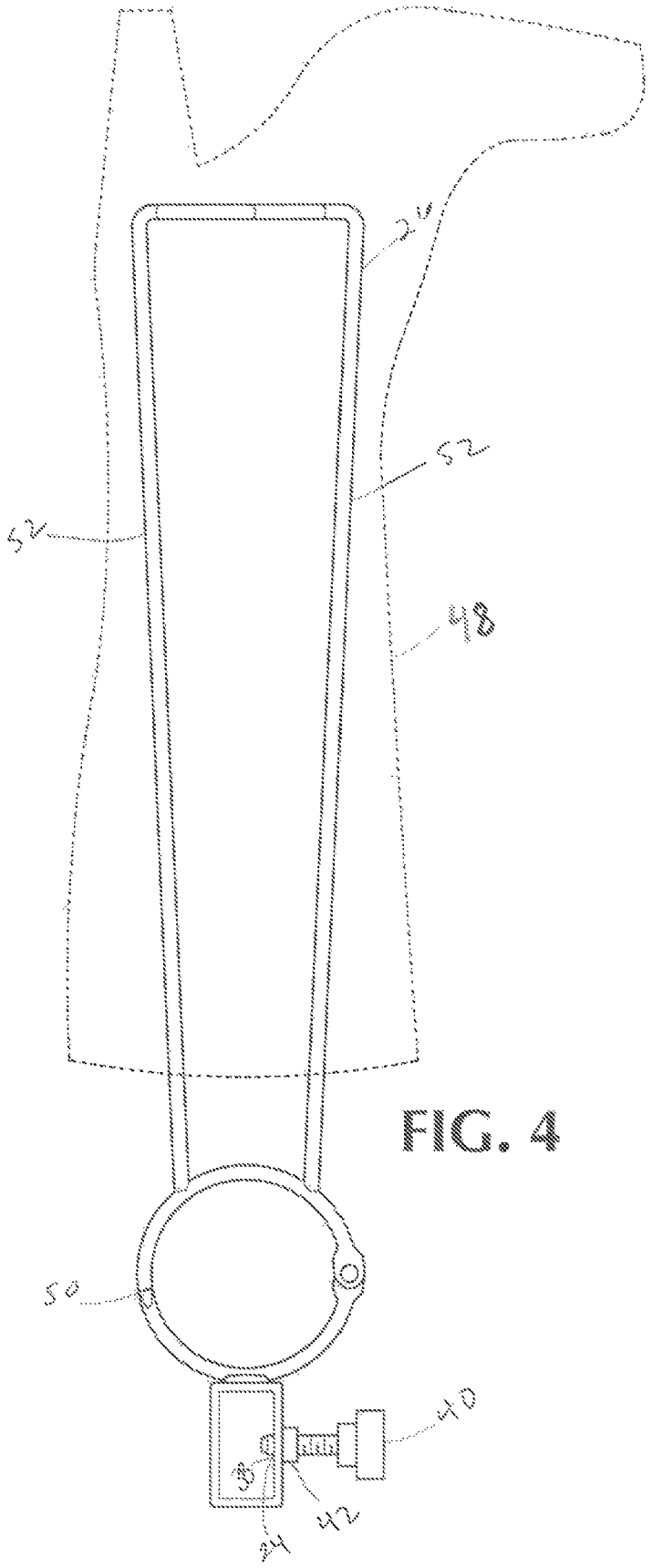
FIG. 4 is a side elevational view of a boot holder with a boot, locked in a vertical position.

The rotating component 34 may be locked into position such that the boot support 26 is vertical, as shown in FIGS. 2 and 4. The rotating component 34 and the fixed component 32 have interlocking elbows 50, which, when aligned, or brought adjacent to one another, slide into a locked configuration. Once locked, the boot 48 may be stored in an upside-down position. An upside-down storage position reduces bending or buckling of the boot material which may otherwise occur in traditional forms of storage. To unlock the elbows 50, a user pulls the rotating component and 34 and the fixed component 32 apart, and disengaged the elbows 50. Once the elbows 50 are disengaged, the rotating component 34 may be rotated forward, as shown in FIGS. 3 and 5, which allows a user to pull a stored boot 48 off of a boot support 26.

In this embodiment of the invention, the boot support 26 includes two elongate support elements 52, joined by an S-shaped element 54. The support elements 52 may have a length that is at least the length of a user's boot. In other embodiments of the invention, the boot support 26 may be constructed using differently-shaped support elements which are of a sufficient length to support a boot upside-down.

In one embodiment, the boot rack 10 includes a frame 12 having a central bar 16 extending between a pair of support feet 14, such that the pair of support feet engages 14 a surface, and at least one elongate boot support element 26 having a first end 28 and a second end 30. The first end 28 of the support element 26 includes a fixed component 32 and a rotating component 34, such that the fixed component 32 is attachable to the central bar 16, and the rotating component 34 is connected to the fixed component 32 via a hinge connection 44. The hinge connection 44 can define an axis 45 which allows the rotating component 34 to rotate about the axis 45.

In another embodiment, the boot rack 10 includes a floor-contacting support base 17 and at least one elongate boot holder 26, which is reversibly attachable to the support base 17, and a hinge 44 that connects the boot holder 26 to the base 14, such that the hinge allows the boot holder to rotate forward and backward around an axis 45 defined by the hinge 44.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A boot rack comprising a frame having a central bar extending between a pair of support feet, such that the pair of support feet engage a surface;

at least one elongate boot support element having a first end and a second end, wherein the first end of the at least one elongate boot support element includes a fixed component and a rotating component, such that the fixed component is fixed relative to the central bar, and the rotating component is connected to the fixed component via a hinge connection;

wherein the hinge connection defines a hinge axis which allows the rotating component to rotate about the hinge axis, wherein the hinge axis is separate from an axis formed by the central bar;

a locking mechanism such that when the at least one elongate boot support element is rotated to a vertically-extending position, a pair of interlocking elbows, located on the fixed component and the rotating component align and slide into a locked configuration, and wherein the interlocking elbow located on the rotating component is structured to come into physical contact with the central bar to stop rotation of the rotating component at a user-selected position of rotation.

2. The boot rack of claim 1, wherein the hinge axis is parallel to the direction of the central bar.

3. The boot rack of claim 1, wherein the elongate boot support element has a length at least the length of a user's boot.

4. The boot rack of claim 1, wherein the elongate boot support element includes dual elongate support elements connected by an s-shaped element.

5. The boot rack of claim 1, wherein the frame includes a planar shelf positioned above the central bar and the at least one elongate boot support element.

6. The boot rack of claim 1, wherein the rotating component may be locked in a position such that the at least one elongate boot support element is in a vertical position.

7. The boot rack of claim 1, wherein the fixed component is attached to a collar which has an aperture shaped to accept the central bar.

8. The boot rack of claim 7, wherein the collar includes a threaded hole, designed to accept a screw, whereby the screw acts as a lock to lock the collar in position on the central bar.

9. The boot rack of claim 8, wherein the central bar includes a hole which accepts the screw to lock the collar in position on the central bar.

* * * * *